US009190252B2

(12) United States Patent
Laser et al.

(10) Patent No.: US 9,190,252 B2
(45) Date of Patent: Nov. 17, 2015

(54) ELECTRODE DEVICE WITH PRE- AND/OR POSTFILTERS AND MANUFACTURING METHOD THEREFOR, AS WELL AS A MASS SPECTROMETER WITH SUCH AN ELECTRODE DEVICE

(71) Applicant: VACUTEC Hochvakuum- & Präzisionstechnik GmbH, Bremen (DE)

(72) Inventors: Bernd Laser, Weyhe (DE); Carsten Laser, Weyhe (DE); Frank Schaefer, Grasberg (DE)

(73) Assignee: VACUTEC Hochvakuum- & Präzisionstechnik GmbH, Bremen (DE)

( * ) Notice: Subject to any disclaimer, the term of this patent is extended or adjusted under 35 U.S.C. 154(b) by 0 days.

(21) Appl. No.: 14/511,449

(22) Filed: Oct. 10, 2014

(65) Prior Publication Data

US 2015/0102213 A1 Apr. 16, 2015

(30) Foreign Application Priority Data

Oct. 11, 2013 (DE) ..... 10 2013 111 254

(51) Int. Cl.

| | |
|---|---|
| ***H01J 49/06*** | (2006.01) |
| ***H01J 49/42*** | (2006.01) |
| ***H01J 49/26*** | (2006.01) |

(52) U.S. Cl.

CPC ..... *H01J 49/06* (2013.01); *H01J 49/063* (2013.01); *H01J 49/068* (2013.01); *H01J 49/26* (2013.01); *H01J 49/4215* (2013.01)

(58) Field of Classification Search

USPC ..... 250/292, 290, 396 R

See application file for complete search history.

(56) References Cited

U.S. PATENT DOCUMENTS

| | | | |
|---|---|---|---|
| 2,939,952 | A | 6/1960 | Paul et al. |
| 7,348,552 | B2 | 3/2008 | Laser |
| 8,173,976 | B2 | 5/2012 | Egley et al. |
| 2004/0245460 | A1 | 12/2004 | Tehlirian et al. |
| 2007/0114391 | A1 | 5/2007 | Mordehai et al. |

(Continued)

FOREIGN PATENT DOCUMENTS

| | | | |
|---|---|---|---|
| DE | 944 900 | C | 6/1956 |
| DE | 22 15 763 | A1 | 10/1973 |
| DE | 10 2004 054 835 | A1 | 5/2006 |

(Continued)

OTHER PUBLICATIONS

German Office Action dated Jun. 2, 2014 in German Application No. 10 2013 111 254.4 with English translation of relevant parts.

(Continued)

*Primary Examiner* — Kiet T Nguyen

(74) *Attorney, Agent, or Firm* — Collard & Roe, P.C.

(57) ABSTRACT

A method manufactures a multipolar electrode device, in particular a multipole for use in a mass spectrometer, wherein the electrode device includes at least one main filter and at least one pre- and/or postfilter. The electrode blanks are separated in several sections for producing the pre- and/or postfilters, which are thereby maintained by a holder in a constant relative position to each other. Moreover, an electrode device may be used in a mass spectrometer and a mass spectrometer may have such a multipolar electrode device.

11 Claims, 5 Drawing Sheets

(56) References Cited

U.S. PATENT DOCUMENTS

| | | | | |
|---|---|---|---|---|
| 2007/0176095 | A1* | 8/2007 | Tong et al. | 250/292 |
| 2011/0016700 | A1* | 1/2011 | Egley et al. | 29/592.1 |

FOREIGN PATENT DOCUMENTS

| | | | |
|---|---|---|---|
| DE | 11 2010 002 730 | T5 | 8/2012 |
| EP | 1 814 138 | A2 | 8/2007 |

OTHER PUBLICATIONS

Miller & Denton, 1986, "The Quadrupole Mass Filter: Basic Operating Concepts", Journal of Chemical Education, vol. 63, No. 7, pp. 617 to 623.

Dawson, 1971, "Fringing Fields in the Quadrupole Mass Filter", International Journal of Mass Spectrometry and Ion Physics, vol. 6, pp. 33 to 44.

European Search Report dated Feb. 4, 2015 in European Application No. 14188177.1 with English translation of relevant parts.

* cited by examiner

ELECTRODE DEVICE WITH PRE- AND/OR POSTFILTERS AND MANUFACTURING METHOD THEREFOR, AS WELL AS A MASS SPECTROMETER WITH SUCH AN ELECTRODE DEVICE

CROSS REFERENCE TO RELATED APPLICATIONS

Applicant claims priority under 35 U.S.C. §119 of German Application No. 10 2013 111 254.4 filed Oct. 11, 2013, the disclosure of which is incorporated by reference.

BACKGROUND OF THE INVENTION

1. Field of the Invention

The invention relates to a method for manufacturing an electrode device, in particular a multipole, for use in a mass spectrometer, whereby the electrode device comprises at least a main filter and at least a pre- and/or postfilter. The invention further relates to such an electrode device, as well as a mass spectrometer with such a multipolar electrode device.

2. Description of the Related Art

Multipolar electrode assemblies for the characterization of the chemical compounds are known in the prior art, for example from German patent specification 944 900. Such multipole mass filters work without a magnetic field. A quadrupole, for example, consists of four metal rods, which serve as electrodes and which are arranged on a circle with radius $R_0$. The voltage at the electrodes is composed of a high-frequency AC voltage and a DC voltage, where the respective opposite pairs of the electrodes have a high-frequency voltage shifted by 180°. The ions to be separated are shot in longitudinal direction of the electrodes into the field as a fine ion beam. Due to the applied AC and DC voltages, the ions are moved along defined trajectories through the mass filter. Outside stable basic conditions the ions collide with the electrodes, whereby the ions are neutralized. This results in that these neutralized ions no longer get to the detector.

The voltage applied to the electrodes is linear to the detected ion mass, wherefore for running through the mass range, thus for adjusting the desired mass to be detected, a proportional change of AC and DC voltage has to be made. A change of the resolution can be caused by varying the voltage conditions. In particular, a stability diagram is important, which is calculated according to the differential equations of Mathieu. A good overview about the functioning of a quadrupole including an explanation of the stability diagram can be found in Miller & Denton, 1986, "The Quadrupole Mass Filter: Basic Operating Concepts", Journal of Chemical Education, Volume 63, No. 7, pages 617 to 623.

When measuring with a multipole, particularly the alignment of the electrodes to each other is important because the alignment must be executed with high accuracy. A manufacturing process for this high-precision alignment is known, for example, from DE 10 2004 054 835 A1. Nevertheless, the problem remains that the border areas of the electrodes represent more unstable zones for ions and thus contribute to a defocusing. This effect was particularly studied by Dawson, 1971, "Fringing Fields in the Quadrupole Mass Filter", International Journal of Mass Spectrometry and Ion Physics, Volume 6, pages 33 to 44. Dawson did simulations based on the findings of Brubaker, who proposed prefilter and postfilter for the first time. Prefilters and postfilters act as a pre- or post-stage of the main filter by only applying an extenuated AC voltage. Thus, the field begins and ends not abruptly for the ions, but the ions are slowly led out or led into the field.

Therefore, the ions reach a higher stability and thus a better focusing. Thereby, the prefilters and postfilters work like a lens.

The high-precision alignment of the electrodes to each other (for example, prefilter to main filter) has to be considered in the implementation of prefilters and postfilters in practical use because even small inaccuracies can lead to field interference. In DE 22 15 763, for example, the implementation of prefilters and postfilters is shown. However, in this case great effort with high costs are involved for high-precision alignment of the filters to each other. Therefore, in the prior art a method is missing, which ensures an accurate alignment with low effort and thus also has a high analytical measurement accuracy.

SUMMARY OF THE INVENTION

It is therefore the object of the invention to improve the manufacturing process for electrode devices with pre- and/or postfilters and to provide a resulting electrode device.

The invention solves this object by showing a method of manufacturing an electrode device with pre- and/or postfilter and providing an electrode device with pre- and/or postfilters as a product. The electrode device thereby consists of several electrode assemblies, which can be assembled to the electrode device. An electrode assembly comprises one or more electrodes. Each electrode is made of an electrode blank, which is preferably made from metal. Particularly preferably, the electrode blank consists of solid material. The electrode blank is preferably rod-shaped and has in particular a round cross-section. The blank can be formed, for example, as a round rod. From this electrode blank, the main filter, one or more pre- and/or one or more postfilters are made. The manufacturing process comprises several steps, which are repeated until the intended number of pre- and/or postfilters are produced. Alternatively, the electrode blank can also have, for example, a trapezoidal or rectangular cross-section and thus, for example, be used for ion guide or ion transfer.

The term of the pre- and postfilters implies that the pre- and postfilters can also be lenses or can have a lens-like function as they preferably focus the ions to let the ions enter into the main filter with a focused beam. In this case, in contrast to the main filter no filtering in the actual sense is taking place, this means little or no ions are neutralized. Whether the pre- and/or postfilters focus or also neutralize ions also depends on whether and how the pre- and/or postfilters are applied with DC voltage. Both possibilities can be realized with the present invention.

For manufacturing an electrode assembly, each electrode blank is connected to holding means. For an electrode device as a quadrupole, for example, the electrode device consists of four electrode blanks, whereby the electrode blanks are split for several electrode assemblies. For example, each electrode assembly consists of two electrode blanks. Alternatively, one of the electrode assemblies comprises only one electrode blank and the other electrode assembly three electrode blanks. Also, the electrode device can be, for example, composed of four single electrode assemblies, each having an electrode blank.

Preferably, the holding means are formed in such a way that they can hold the electrode rod assemblies like a device. They also can be referred to as a holding device.

More preferably, the holding means have at least one carrier element, wherein each electrode blank is connected to one or more carrier elements. In particular, the attachment is either indirectly, by the interposition of one or more insulators, or directly. If one or more blank electrodes are attached directly to at least one carrier element, the at least one carrier element is preferably formed as an insulator. Due to the holding means, in particular the carrier elements, the electrode assemblies can be connected to each other and can be joined together as an electrode device.

The holding means can therefore be formed as a carrier element or carrier elements, as at least one insulator or as a carrier element or carrier elements and at least one insulator.

In a further step, each electrode blank is separated into two sections, where the sections by means of a gap are axially spaced apart from each other. The gap thus extends through the entire electrode blank, separating the two sections from each other electrically, so that the individual sections can be applied with voltage independently. The sections are maintained in a constant relative position to each other during and after the separation by the holding means. In the finished electrode device each of the sections is used together with the sections of the other electrode blanks as a filter. For example, several first sections compose a prefilter and several second sections compose a main filter. A "set" of filter sections (for example, a first and a second section as prefilter and main filter) is thus made of one single electrode blank, wherein the holding means maintain the sections to each other in position at any given time in such a way that the relative position is not changed between the sections. This method has the advantage that the separation between a prefilter or postfilter and the main filter happens only when the two sections are fixed together by the holding means. A shifting of the sections against each other and a re-alignment is thus omitted and additional effort is spared. Due to the exact positioning of the electrodes, the analytical measurement accuracy is increased.

This separation step, i.e. the separating of the electrode blanks into two sections, is carried out as often as it corresponds to the intended number of the pre- and/or postfilter. The number of electrode blanks corresponds to the number of desired electrodes. For example, if a prefilter and postfilter are required, the electrode blanks are separated twice in two sections, so that each electrode blank has three sections in total, which are axially spaced apart from each other with a gap and are maintained in a constant relative position to each other due to the holding means. The overall three sections are then used together with the sections of the other electrode blanks as prefilter, main filter and postfilter. In a further step, the several electrode assemblies are joined together by means of the holding means thus becoming the electrode device.

In a preferred embodiment, the holding means comprise at least one carrier element, in particular one single carrier element, and insulating means, which comprise at least one insulator. The insulator or insulators, that is non-conductive material, comprise preferably quartz or ceramics, whereas in case that the insulating means consist entirely of quartz, the material of the electrode blank is preferably made of (for example, distributed under the trademark "Invar") alloy with the material number 1.3912 (German steel key). In case that the insulating means consist of ceramics, the metal of the electrode blank is preferably a iron-nickel-cobalt-based melt down alloy, for example, like the (distributed under the trademark "Vacon") alloy with the material number 1.3981 (German steel key) or respectively the under the designation "Vacon 11" or "Vacon 11 T" available alloy.

The insulating means are preferably connected to the electrode blank, wherein this connection can be formed in a detachable or non-detachable way. Preferably, the insulator or insulators are applied with glue, by screws or by soldering to the electrode blank. However, it is, for example, also possible to sinter the insulating means, in particular if they are made of ceramics on the electrode blank. The metal of the electrode and the insulators preferably have a similar thermal expansion coefficient, so that a permanent connection between the metal and the insulator is ensured.

The carrier element is preferably connected to at least one insulator of the insulating means. If the insulating means comprise several insulators, the carrier element is connected to at least one of the said insulators. If the insulating means comprise only one insulator, the carrier element is connected to exactly this insulator. The carrier element, which preferably has a cross-section in a semi-circular arc-like shape, is preferably made from the same material as the electrode blank. The carrier element and the insulator or insulators are preferably connected detachable or non-detachable to each other. Preferably, the connection is provided by gluing with an adhesive, by soldering, by means of screws or by sintering. More preferably, the insulator is connected by gluing to the carrier element, so that a permanent connection is established.

Preferably, at least one insulator of the insulating means and/or the carrier element is connected to both sections, thereby maintaining the sections in the constant relative position to each other. When the insulating means comprise several insulators, thus at least one of the insulators and/or the carrier element is connected to both sections. If the insulating means comprise only one insulator, this one insulator and/or the carrier element is connected to both sections. The insulator acts insulating between the electrode blank and the carrier element, so that the electrode blank and the carrier element, for example, can also consist of the same material.

The insulating means can, for example, comprise several short insulators, a long insulator or a combination of these two solutions. Thereby, the insulator or insulators are constructed or positioned in such a way that a stable connection between the two sections is given. For example, one or more short insulators can be each positioned on the sections. The carrier element then connects the insulators, so that the sections are connected to each other by the carrier element and the insulators. When separating the electrode blank, for example, between two insulators, the two sections are maintained by the carrier element in a constant relative position to each other. Alternatively, for example, a long insulator can be positioned on the electrode blank, so that it is connected to both sections. The carrier element is then positioned on the insulator.

In a preferred embodiment, the insulating means, in particular an insulator of the insulating means, maintain the sections in the constant relative position to one another. Particularly preferred, the electrode blank and/or the insulator are provided with a recess. The recess or the recesses are thereby arranged in such a way that they are positioned between the insulator and the gap and the gap is connected to the recess or the recesses. The gap thus extends between the cavity of the recess and the side of the electrode blank, which faces the cavity of the recess. Providing the insulator or the electrode blank with a recess has the advantage that the insulator, which is located above the separating spot of the gap, does not get in contact with the separating tool.

Preferably, on one carrier element, two electrode blanks are applied, which are each divided into different filters. For example, such an assembly comprises two sections, which are provided to become main filters and two sections, which are provided to become prefilters, whereby in any case a main filter section and a prefilter section are connected to each other by an insulator.

The order of the above-mentioned steps can be varied. For example, first of all a first recess is formed into the electrode blank, which divides the electrode blank into two sections.

Then, an insulator is positioned above the recess and connected to both sections. During the subsequent separation of the two sections by a gap, these sections are maintained in a constant relative position to each other by the insulator. Thereafter, a carrier element is connected to the insulator to be joined together in a further step with a further carrier element to an electrode device. Alternatively, for example, after applying several short insulators on the electrode blank, the carrier element is connected to the insulators and the separating cut between the insulators is executed. However, the possible embodiments are not limited to these two examples.

In a preferred embodiment, the gap is formed in such a way that the presence of an insulator and/or a carrier element, which are positioned above the gap, has no effect on the field geometry of the multipole due to this gap and thus does not affect the trajectory of ions.

The trajectory of the ions or respectively the main direction of movement of the ions by neglecting their circular movement is arranged longitudinally to the electrode blank, namely in particular on the side of the electrode blank, which is facing the side of the electrode blank applied with insulating means. The trajectory of the ions thus substantially corresponds to a longitudinal axis to the electrode blank, which is, according to the above-mentioned criteria, in particular arranged on the opposite side of the insulating means. In order to avoid the influence of the field geometry, advantageously no perpendicular to said longitudinal axis forms a visual axis to the insulating means and/or the carrier element. A perpendicular in this context is an axis, which is at a 90°-angle to the longitudinal axis.

Advantageously, the gap therefore has, for example, angles or is stair-like or slanting and/or the entry and exit point of the gap out of the blank are offset from one another. In particular, an embodiment with angles or a stair-like embodiment prevents that the so-called "needle-point effect" disrupts the field geometry. More preferably, the gap has angles and the entry and exit point of the gap out of the blank are offset from one another.

Such a formation has the advantage that the probability that the ions get through the gap to the insulator is highly reduced. The ions thus cannot establish a direct contact with the surface of the insulator. Therefore, the ions cannot react with the surface of the insulator and therefore no electrostatic charge of this surface can take place because of the ions. At that charge the ion would assimilate an electron of the insulator and would thus be neutralized. The insulator on the other hand would be positively charged, which would change the field geometry. A change in an electric field would affect the trajectory of following ions.

The cut of the gap starts, for example, at the recess and continues in the direction of the opposite side of the blank. The first section is thus formed across to the longitudinal axis of the blank, a second section along the longitudinal axis, then followed by another section, which is again aligned across to the longitudinal axis. Of course, further angles can be implemented by more longitudinally and crosswise running sections to the longitudinal direction in the embodiment of the gap.

Further preferred, the transition from the recess to the gap and the exit point of the gap out of the electrode blank are offset against each other, whereby between a prefilter and a main filter the exit point of the gap out of the electrode blank is in particular preferably offset in the flight direction of the ions. This prevents that an undefined electric field occurs by charging the surface of the insulator, which would affect the trajectory of the other ions.

The offset between the entry and exit point of the gap in or out of the electrode blank can be formed mirror-inverted at the transition between the main filter and postfilter to the transition between prefilter and main filter, or it can be formed in the same way, thus not mirror-inverted. A mirror-inverted embodiment has the advantage that the main filter is symmetrically formed. This results in a more homogeneous field, which means less interference for the ions. A similar embodiment, however, could also take advantage of the transition between the main filter and the postfilter that the probability that the ions get to the insulator is kept even lower because the exit point of the gap out of the electrode blank is offset in flight direction.

In a preferred embodiment, in a further step, the sections of the electrode blank are machined together at the same time with the carrier element in such a way that the outlines of the blank and the carrier element are ground. Namely, the machining is preferably carried out by grinding, in particular by the use of a grindstone. Thereby, the individual sections of the electrode blank are ground preferably in the longitudinal direction, so that in the cross-section of the electrode blank, a circular and a non-circular, in particular substantially hyperbolic section, is formed. This has the advantage that a better field geometry is established, resulting in a more accurate measurement. The processing of electrode blank and carrier element together by, for example grinding, can take place chronologically before separating the electrode blank into the two sections. Preferably, however, the processing is executed after the separating cut. Alternatively, the processing of the electrode blanks can be omitted, for example, to save costs.

The end sections of the carrier elements are formed convex and concave by the machining, so that they center themselves when the carrier elements are joined by pairs later. Such procedure has the advantage that a very precise alignment of the electrodes to each other is ensured and thus the electrodes need no adjustment after the grinding. In particular, this procedure results in an accuracy of electrode surfaces to each other by <1 micron.

By the machining of the individual sections, each section becomes an electrode. Due to the processing, each of these electrodes has a circular section and a substantially hyperbolic section in the cross-section. Each identically processed section of all electrode blanks provides, in particular after joining to the electrode device, the individual filters such as prefilter and main filter.

In a preferred embodiment, the recess is formed into the electrode blank by the manufacturing process of machining or non-machining (erosive). Machining processes can be, for example, milling, sawing, planing, sanding or drilling. Non-machining or erosive methods can, for example, be carried out by chemical or thermal erosion. Thus, the method of electro-discharge machining, etching, laser cutting or water jet cutting are also included. Preferably, the recess is formed into the electrode blank by a machining process. In particular, the recess is sawed into the electrode blank. Alternatively, the recess can be also formed while manufacturing the blank by casting.

In a preferred embodiment, the gap, which separates the sections of the electrode blank from each other, is manufactured by a machining and/or non-machining manufacturing process. In particular, the gap is ground, milled or sawn, for example with a wire saw, into the electrode blank in a machining process. Alternatively, if using a non-machining manufacturing process, the gap is established by electro-discharge machining, etching, laser cutting or water jet cutting. In particular, the manufacturing of the gap is made by means of wire-electro-discharge machining. The use of wire-electro- or electro-discharge machining has the advantage that substantially no mechanical stresses are generated in the components and a very precise erosion of the metal is possible. Due to initially forming the recess, it is prevented that the tool, for example the eroding wire, comes into contact with the insulator during the manufacturing of the gap. The insulator maintains the two sections together during and after the separation and works as an insulator between the electrode and the carrier element.

A separation between pre- or postfilter and main filter is necessary to be able to apply the different sections with different AC and DC voltage. The pre- or postfilter is preferably applied only with an AC voltage. Despite this separation between pre- or postfilter and main filter, an electrode or an electrode device results from the present invention where no re-adjustment between the different sections is necessary because an insulator or the carrier element holds both sections of the electrode blank together during the separation of the electrode blank.

Thus, the invention shows an effective method for manufacturing an electrode device with pre- and/or postfilters, where the electrodes are aligned with high precision, particularly with respect to the filter sections among each other and the distances to the other electrodes of the multipole. The electrode device resulting from the method according to the invention has extremely straight electrode rods, which have a very high parallelism to each other. Thus, a multipolar electrode device with pre- and/or postfilters is possible, which works with high precision and represents a major improvement in the prior art. In particular, the measurement method offers, thanks to the invention, a higher transmission rate of the ions and a higher resolution by better bundling or focusing of the ion beam.

The product of the manufacturing process according to the invention, namely a very accurate working electrode device, has several electrode assemblies having the following features: at least one electrode blank, holding means and a gap, which separates the electrode blank into two sections, so that they are axially spaced apart from each other and are therefore electrically separated from each other. The holding means comprise thereby insulating means and a carrier element, where either at least parts of the insulating means or the carrier element maintain the two sections in a constant relative position to each other. Preferably, at least one insulator of the insulating means and/or the electrode blank has a recess, which, in particular has a greater extension in the longitudinal direction of the electrode blank than the gap. Further preferably, at least one insulator of the insulating means is connected to the electrode blank and the carrier element. In particular, two of the electrode blanks are connected to a carrier element and are machined together, so that each electrode sections have a circular section and a hyperbolic section and the carrier elements are able to self-adjust during connecting, whereby providing an electrode device.

The invention preferably comprises a multipolar electrode device with at least two electrode assemblies according to the invention. Preferably, the electrode device is a multipole, in particular quadrupole and made of two electrode assemblies according to the invention. The electrode assemblies preferably each comprise two sections, which are formed as a main filter and at least two sections, which are formed as prefilters and/or at least two sections, which are formed as postfilters. The single sections are assembled according to the invention. The electrode assemblies are preferably connected to each other by the carrier elements, so that they are an electrode device. In particular, the carrier elements center themselves to each other due to the ground end sections, which are convex and concave and fit exactly into one another.

The invention further comprises a mass spectrometer having an electrode device according to the invention or several electrode assemblies according to the invention.

BRIEF DESCRIPTION OF THE DRAWINGS

Further advantageous embodiments are evident from the in detail explained embodiments out of the accompanying drawings. The drawings are showing.

DETAILED DESCRIPTION OF PREFERRED EMBODIMENTS

Identical reference numbers in the figures refer to identical parts. The numbers marked with additional letters, i.e. numbers 9, 13, 15, 17, 19 and 25, for example 17*a*, indicate the respective parts in each embodiment. If there is no indication of a letter, all embodiments of the respective part are meant. If the term, for example "insulator 17", is indicated, all embodiments of the insulator, namely 17*a* to 17*k* are meant.

Figure 1:
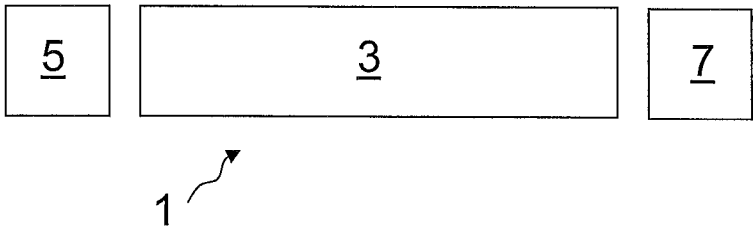
FIG. 1 is a schematic view of an electrode with pre- and postfilter.

FIG. 1 shows a schematically simplified electrode assembly 1 for use in a multi-pole electrode assembly, in particular in a multipole, in a mass filter or in a mass spectrometer. The electrode assembly 1 comprises, inter alia, a section for a main filter 3, a section for a prefilter 5, and a section for a postfilter 7. The invention is not limited to this embodiment. Thus, for example, an electrode assembly 1 according to the invention can have only one section for a prefilter 5 or only one section for a postfilter 7.

The section for the prefilter 5 and the section for the postfilter 7 are electrically separated from the section for the main filter 3 by gaps, in order to be able to be applied variably with AC and DC voltage. The ions, which are to be detected according to the adjusted mass at a multipole in operation, get, for example, through a field of a prefilter 5, where initially only AC voltage is applied, in the field of the main filter 3, where the DC voltage is switched on in addition. The prefilter 5 ensures that the ions enter the field of the main filter 3 at a stable state, resulting in a better focusing of the ions. Therefore, the pre- and postfilter 5, 7 work like lenses.

In the field of the main filter 3, the ions are filtered according to their mass-to-charge ratio, whereas ions, which do not correspond to the desired mass and thus should be sorted out, are attracted to the electrodes charged with DC voltage and are neutralized when colliding with the electrode assembly 1.

The ions, which are to be counted and in return should therefore strike the detector, are kept from defocusing due to an abrupt crashing field at the end of the main filter 3 by the postfilter 7. Here, for example, DC voltage and AC voltage are gradually weakened or the DC voltage is completely switched off, in order to achieve an even higher focusing. Preferably, a postfilter 7 is used in the cases when other ion-optical components are provided.

Figure 2:
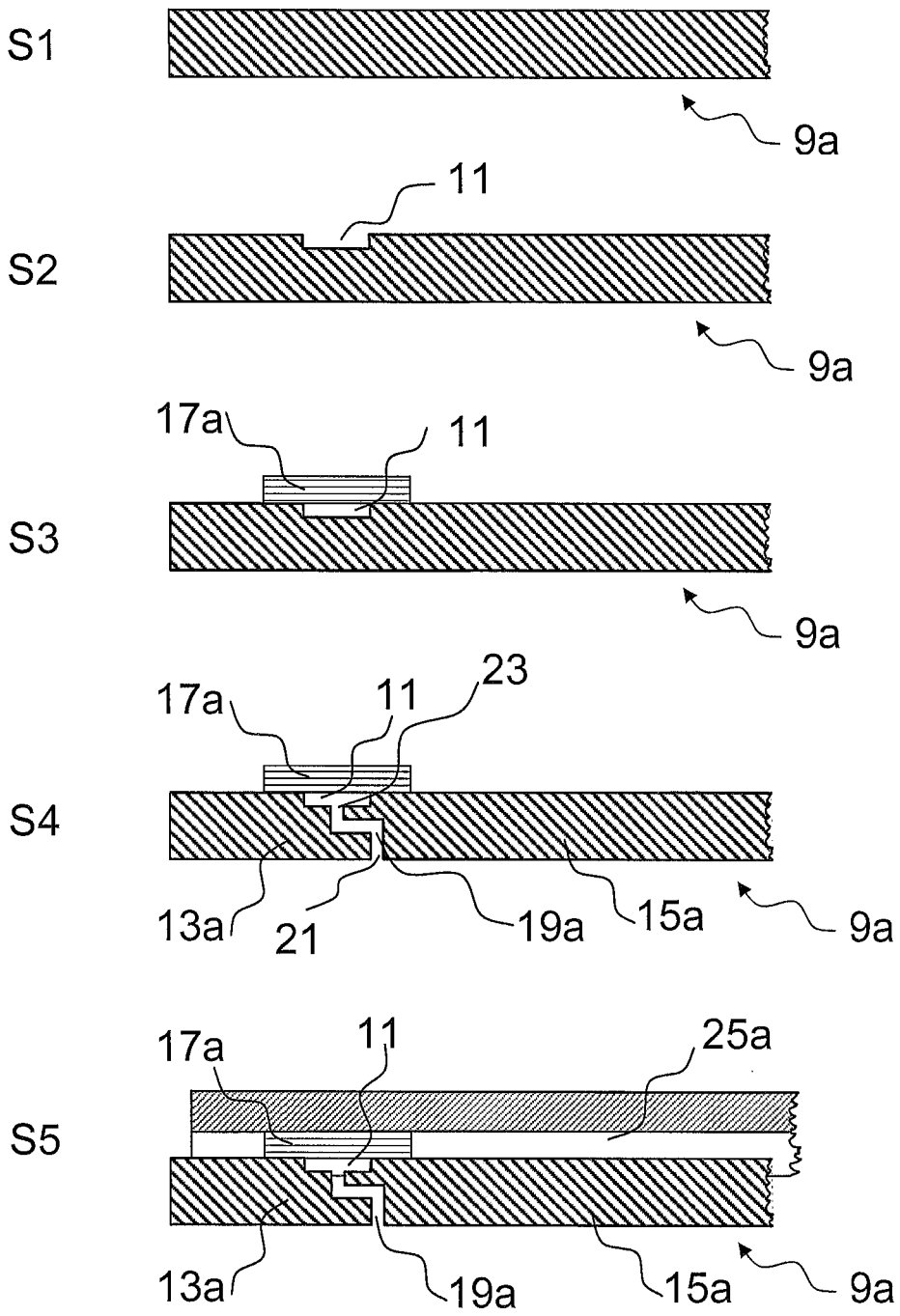
FIG. 2 is a schematic representation of the method steps S1 to S5 to manufacturing an electrode assembly with a prefilter section.

FIG. 2 shows a schematic representation of the method steps S1 to S5 of the manufacturing of an electrode assembly 1 with a prefilter 5. Postfilters 7 can be produced in an analog manner. In S1, an unprocessed electrode blank 9*a* is shown first. The blank is preferably made of metal, where, in particular the metals Invar or Vacon come into question. In particular, the electrode blank 9 is made of a round rod. Alternatively, however, the electrode blank 9 can also have a trapezoidal or rectangular cross-section, where it can then be utilized for guiding the ions, for example around curves.

In step S2, for example, by sawing or milling, a recess 11 is formed into the electrode blank 9*a*. This recess 11 is not passing through the entire electrode blank 9*a*, but only affects the surface. The recess 11 divides the electrode blank into two electrode sections 13*a*, 15*a*, which represent the single filters (for example, main filter and prefilter) at the end of the manufacturing process.

In a step S3, an insulator 17*a* is applied to the electrode blank 9*a*, so that the insulator 17*a* covers the recess 11 partially or completely and the recess 11 is thus provided as a cavity in the electrode blank 9*a* under the insulator 17*a*. The insulator 17*a* is then connected to the two sections 13*a*, 15*a*. Preferably, the connection between the insulator 17 and the electrode rod assembly 9 is not detachable and is implemented by an adhesive. Preferably, the insulator 17 is made of quartz. Alternatively, the insulator 17 can also consist of ceramics. Preferably, the metal of the electrode blank 9 has a similar thermal expansion coefficient like the insulator, so that a permanent connection between the metal and the insulator 17 is possible.

In a step S4, a gap 19 is produced between the cavity and the opposite side of the electrode blank 9. Due to this gap 19, the sections 13, 15 are axially spaced apart form each other. Thus, there is an electrical separation between the sections 13, 15, so that the sections 13, 15 can be applied with voltages independently. The insulator 17 maintains the sections 13, 15 in a constant relative position to each other during the separation process, so there is no need for costly adjustment.

Different methods are suitable for the embodiment of the gap 19. In particular, milling, drilling, sawing and electro-discharge machining come into question. Preferably, when sawing, a wire saw or a saw-wire is used. The saw-wire, for example, can be applied with diamond segments at short intervals. This method makes it possible to flexibly form the gap and, for example, also to contribute corners. Particularly preferably, the manufacturing of the gap 19 can be conducted by wire-electro-discharge machining. The recess 11 prevents that, for example, the eroding wire gets into contact with the insulator 17 during the separation of the electrode blank 9 into the two sections 13, 15.

A continuous cut of the gap 19 is necessary to wire the two sections 13 and 15 of the electrode blank 9 separately from each other. In FIG. 2, the first section 13*a* can be regarded as a future part of the prefilter 5 and the second section 15*a* as a future part of the main filter 3. In case that a manufacturing of a postfilter 7 is carried out, the first section 13*a* corresponds to the main filter 3 and the second section 15*a* corresponds to the postfilter 7.

Preferably, the separation of the two sections 13, 15 caused by the recess 11 and the gap 19 is formed in a way that no perpendicular to the longitudinal axis of the electrode blank 9 forms a visual axis to the insulator 17. This has the advantage that the ions cannot get in contact with the insulator 17 and thus, there can be no surface charge of the insulator 17 due to the ions. A surface charge of the insulator 17 would adversely affect the field geometry.

Preferably, the gap 19*a* has angles or is formed stair-like in the last-mentioned embodiment. The exit point 21 of the gap 19*a* out of the electrode blank 9*a* is preferably displaced opposite to the transition 23 between the recess 11 and the gap 19*a*. Preferably, this offset is formed at the transition from prefilter to main filter in flight direction of the ions, that means the exit point 21 is located closer to the main filter 3. Therefore, a contact of ions with the insulator 17*a* is even more unlikely because the ions, once moved in a direction, most likely will not move in the opposite direction to get through the gap 19*a* to the insulator 17*a*. A saw wire or a wire saw or the method of electro-discharge machining is preferred for the cutting of angles or for the stair-like embodiment because thereby very flexible cuts are possible.

In a step S5, at least one carrier element 25*a* is connected to the insulator 17*a*. The connection between the insulator 17 and the carrier element 25 is preferably carried out by gluing. On the carrier element 25, which is preferably formed in cross-section as a semi-circular arc, a preferably further machined electrode blank 9 is assembled. In a step S6 (not shown), the electrode blanks 9 are processed together with the carrier elements 25. The joint processing is preferably conducted by grinding, in particular by a grindstone. The cross-sections of the electrode blanks 9 get thereby a circular section and a non-circular, in particular substantially hyperbolic section. The end sections of the carrier elements 25 are simultaneously formed convex and concave, to achieve a self-centering during subsequent assembly with an additional carrier element 25.

The advantage of such a method is a very precise assembly of electrode surfaces to each other, which could otherwise only be achieved with much more effort after grinding the components.

Figure 3:
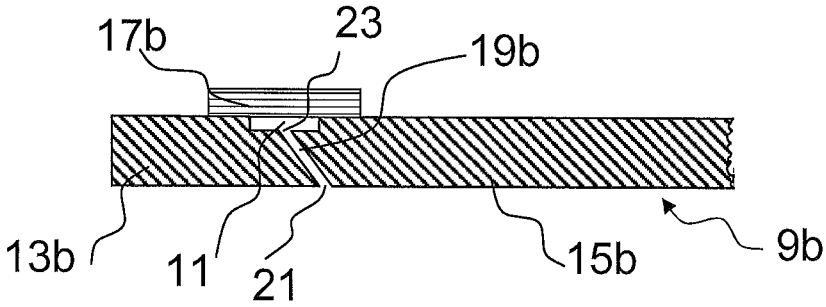
FIG. 3 is an alternate embodiment of the method step S4 shown in FIG. 2.

FIG. 3 shows an alternate embodiment of step S4, in particular of the gap 19*a* in FIG. 2. The gap 19*b* is thereby formed in such a way that it has an oblique cut. Again, it is advantageous when—at least at the transition between the prefilter and main filter—the exit point 21 of the gap 19*b* out of the electrode blank 9*b* is closer to the main filter 3 than the transition 23 between the recess 11 and the gap 19*b*.

Figure 4:
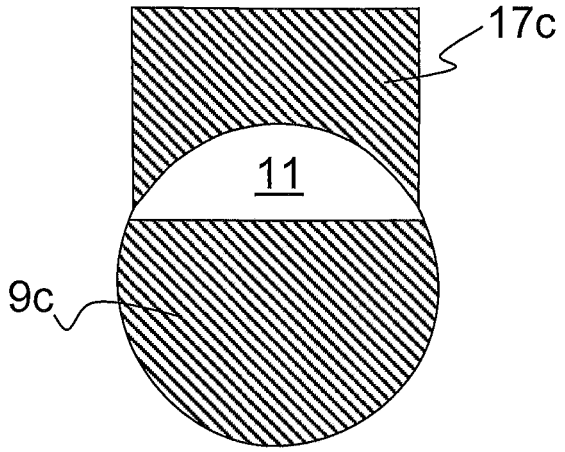
FIG. 4 is a schematic cross-sectional view of method step S3 shown in FIG. 2.

FIG. 4 shows a cross-sectional view of step S3, where the viewer looks directly into the recess 11. The upper part of the electrode blank 9*c* is removed for the formation of the recess 11. The insulator 17*c* is positioned over the recess 11, so that the recess 11 is at least partially covered by the insulator 17*c*. The gap 19*c* (not shown here) is then, for example, produced by wire-electro-discharge machining between the future exit point 21 and the cavity of the recess 11.

Figure 5:
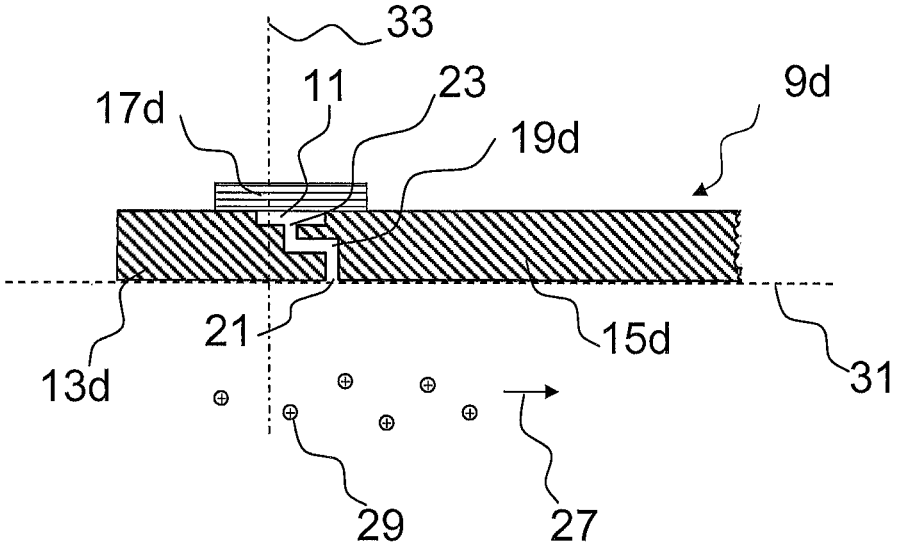
FIG. 5 is an explanatory model to the embodiment of the gap according To step S4 of FIG. 2, FIG. 6-9 show several alternate embodiments of the invention

FIG. 5 shows a schematic view of the electrode blank 9*d*. The flight direction 27 of the ions 29 is set in longitudinal direction, thus, parallel to the longitudinal axis 31 of the electrode blank 9. The longitudinal axis 31 is thereby arranged at the side of the electrode blank 9, which is opposite to the side on which the insulator 17 is applied. No perpendicular 33 to the longitudinal axis 31 of the electrode blank 9 is a visual axis to the insulator 17. Particularly, this is ensured by angles and the offset of the entry and exit point 21, 23 of the gap 19*d* in or out of the electrode blank 9*d*. Due to this method, it is completely or at least partially prevented that the ions 29 charge the surface of the insulator 17*d* electrostatically, thereby changing the field geometry.

Figure 6:
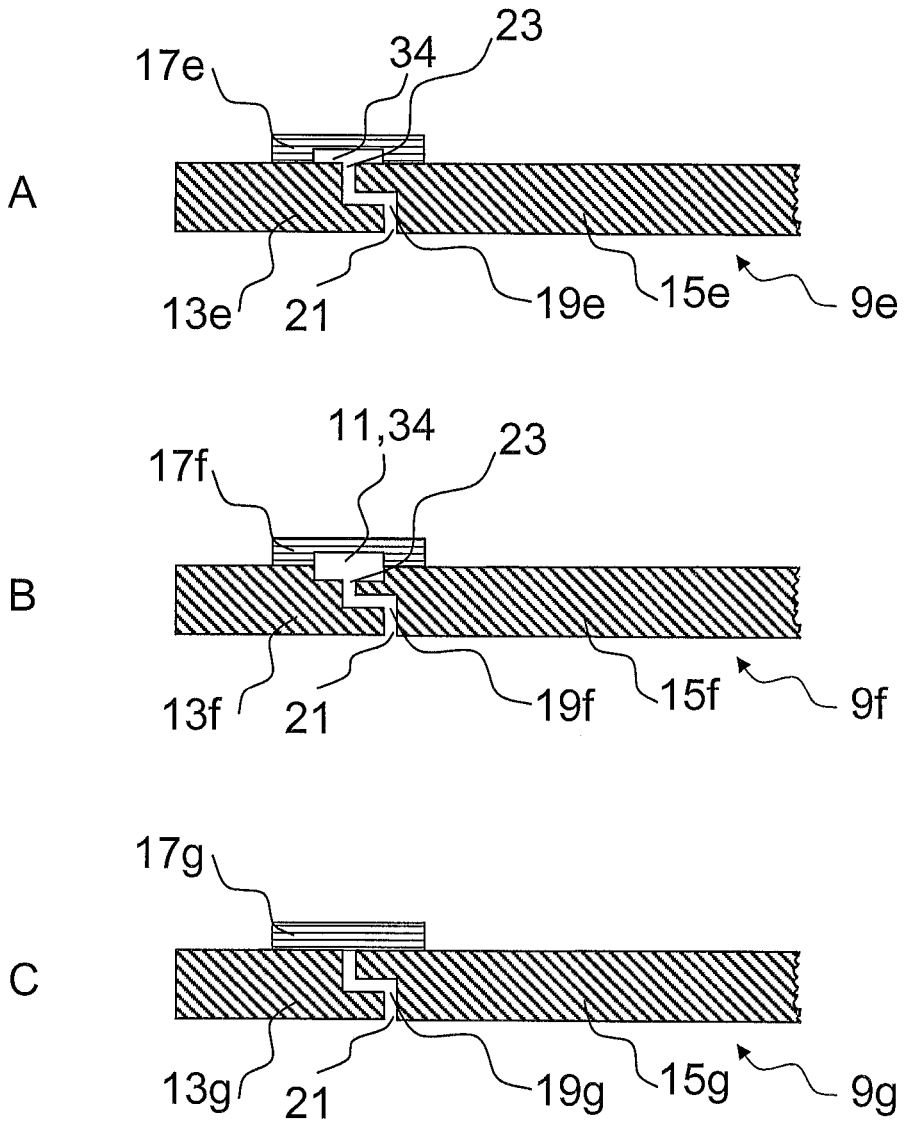

FIG. 6 shows alternate embodiments A, B and C of step S4 of FIG. 2. FIG. 6A shows a recess 34, which is formed into the insulator 17*e* instead of the electrode blank 9*e*. Alternatively, as shown in FIG. 6B, the recess 11, 34 can be in the electrode blank 9*f* and in the insulator 17*f*. The recess 11, 34 respectively prevents that the separating tool comes into contact with the insulator 17*f* during separation of the electrode blank 9*f* into the two sections 13*f*, 15*f*. This is particularly important when the gap 19*f* is formed by electro-discharge machining into the electrode blank 9*f*. As a further alternative, as shown in FIG. 6C, the insulator 17*g* and the electrode blank 9*g* can be without a recess 11, 34.

Figure 7:
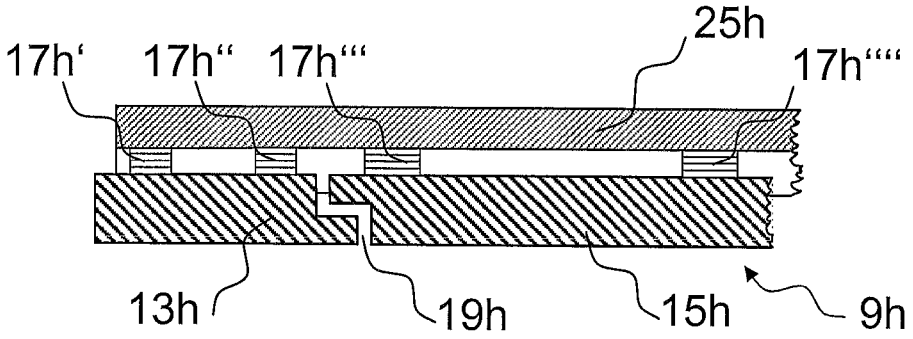

FIG. 7 shows an alternate embodiment of the product according to the invention. There are shown several short insulators 17*h*' to 17*h*"", wherein two of the insulators 17*h*' to 17*h*"" are arranged on a section 13*h*, 15*h*. The use of several insulators 17*h*' to 17*h*"", in particular by the arrangement in the outer areas of the sections 13*h*, 15*h* increases the stability of the electrode assembly 1. The carrier element 25*h* is connected to the insulators 17*h*' to 17*h*"", whereby the two sections 13*h*, 15*h* are thus maintained in a constant relative position to each other due to the carrier element 25*h*. Preferably, the gap 19*h* is also in this case formed stair-like, so that here is also no visual axis established to the carrier element 25*h*. The insulators 17*h*' to 17*h*"" can also have different lengths.

Figure 8:
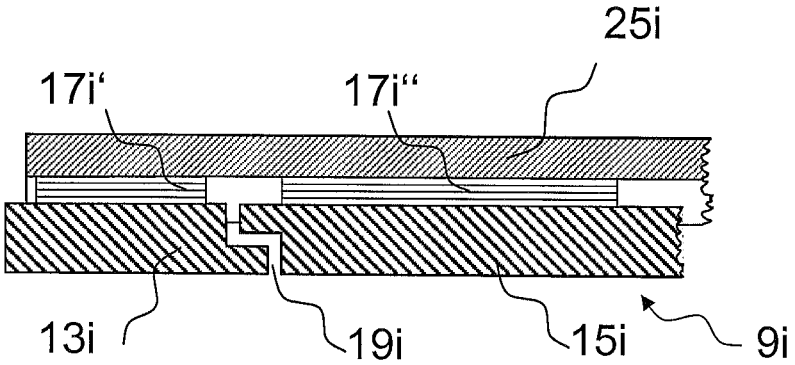

FIG. 8 shows a further alternate embodiment, one long insulator 17*i*', 17*i*" each is arranged on each one of the sections 13*i*, 15*i*. Such an embodiment, like the use of several short insulators 17*h*' to 17*h*"" in FIG. 7, also increases the stability of the electrode assembly 1.

Figure 9:
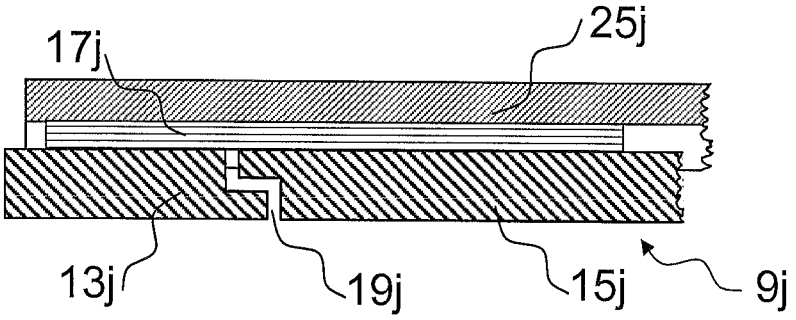

FIG. 9 shows a further alternate embodiment, where a long insulator 17*j* connects both sections 13*j*, 15*j* to each other. In this case, no longer the carrier element 25 is maintaining the sections 13*j*, 15*j* together and in a constant relative position to each other, but the insulator 17*j*, which is positioned above the gap 19*j*.

Figure 10:
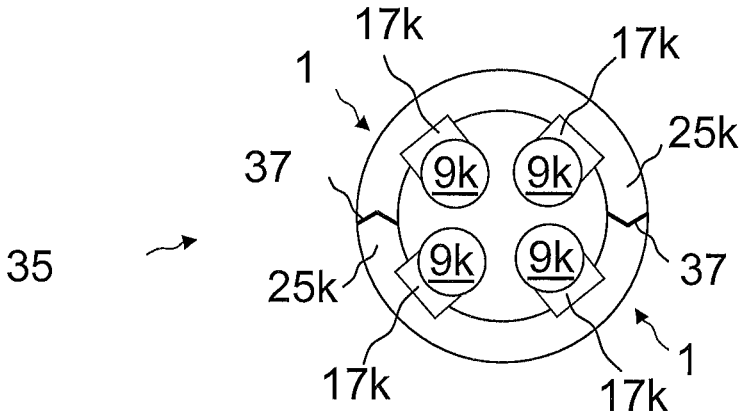
FIG. 10 is a schematic drawing of a side view of an electrode device.

FIG. 10 shows an electrode device 35, which consists of two electrode assemblies 1. The electrode assemblies 1 each have a carrier element 25, where the end sections 37 of the carrier elements 25 are formed convex and concave and fit with the respective other carrier element 25 into each other. The electrode blanks 9 are each attached to the inner surface of the carrier elements 25 by insulators 17 on the carrier elements 25. The electrode assemblies 1 are preferably machined, particularly ground, prior to the assembly to the electrode device 35, so that the electrode blanks 9 each have a circular section and a substantially hyperbolic section (not shown here) and the carrier element 25 gets the convex- and concave-shaped end sections 37. The carrier elements 25 can extend either over almost the entire length of the electrode blanks 9 or as annular elements at individual positions. When installed in a mass spectrometer, the electrode device 35 is attached by means of the carrier elements 25 in the mass spectrometer.

All features mentioned in the above description and in the claims are individually and in optional combination combinable with the features of the independent claims. The disclosure of the invention is thus not limited to the described or claimed feature combinations. In fact, all reasonable combinations of features are disclosed in the scope of the present invention.

What is claimed is:

1. A method of manufacturing a multipolar electrode device, in particular a multipole, for use in a mass spectrometer, wherein the electrode device comprises at least one main filter and at least one pre- and/or postfilter, wherein the electrode device comprises several electrode assemblies wherein each electrode assembly comprises one or more rod-shaped electrode blanks and the following steps are carried out for the creation of the electrode assembly:

a) connecting each of the electrode blanks with holding means, b) separating each electrode blank into two sections, whereby said sections are axially spaced apart from each other by a gap and the sections are maintained in a constant relative position to each other during and after the separation by the holding means, whereby this separation step is carried out as often as it is the intended number of the pre- and/or postfilters and wherein several electrode assemblies are joined together to the electrode device by connecting the holding means, c) providing insulating means and a carrier element as part of the holding means, connecting the insulating means to said electrode blank and connecting the carrier element to at least one insulator of the insulating means, wherein the at least one insulator is connected to both sections, so that the at least one insulator maintains the sections in the constant relative position to each other, and d) providing a recess or recesses in the electrode blank and/or the at least one insulator, whereby the recess or the recesses is or are arranged in such a way that the recess or the recesses is or are positioned between the at least one insulator and the gap and the gap is connected to the recess or the recesses.

2. A method according to claim 1, wherein the gap is formed in such a way that, starting from a longitudinal axis of the electrode blank, which is arranged on the side of the electrode blank, which is opposite to the side with the insulator, no perpendicular to said longitudinal axis forms a visual axis to the insulator and/or to the carrier element.

3. A method according to claim 1, wherein the electrode blank is machined together with the carrier element in such a way that the cross-section of the electrode blank receives a circular section and a non-circular, in particular mainly hyperbolic section and the carrier element receives two differently shaped end sections, which fit to each other.

4. Method according to claim 1, wherein the gap is made by sawing, milling, grinding, laser cutting, water jet cutting, etching or electro-discharge machining.

5. A method according to claim 1, wherein the recess in the electrode blank and/or the at least one insulator is made by sawing, milling, grinding, laser cutting, water jet cutting, etching or electro-discharge machining and the recess in the electrode blank is alternatively provided by means of casting.

6. Multipolar electrode device, in particular multipole for use in a mass spectrometer, wherein the electrode device comprises at least a main filter and at least one pre- and/or postfilter, wherein the electrode device comprises several electrode assemblies, wherein each electrode assembly comprises one or more rod-shaped electrode blanks, and a) each of the electrode blanks is connected to holding means;

b) for each pre- and/or postfilter a gap separates the electrode blanks into two sections, wherein the sections are axially spaced apart from each other by means of the gap and the holding means maintain the sections in a constant relative position to each other and that several electrode assemblies are assembled to the electrode device by connecting the holding means;

c) insulating means and a carrier element are part of the holding means and the insulating means are connected to said electrode blank and the carrier element is connected to at least one insulator of the insulating means, whereby said at least one insulator is connected to both sections, so that the at least one insulator maintains the sections in the constant relative position to each other; and d) the electrode blank and/or the at least one insulator has a recess which is or are connected to the gap and which separates or separate the at least one insulator from the gap.

7. Electrode device according to claim 6, wherein the gap is designed in such a way that, starting from a longitudinal axis of the electrode blank which is arranged on the side of the electrode blank, which is opposite to the side with the insulator, no perpendicular to said longitudinal axis forms a visual axis to the insulator and/or to the carrier element.

8. Electrode device according to claim 6, wherein the electrode blank is machined together with the carrier element in such a way that the cross-section of the electrode blank has a circular section and a non-circular, in particular mainly hyperbolic section and the carrier element has two differently shaped end sections, which fit to each other.

9. Electrode device according to claim 6, wherein the gap is made by sawing, milling, grinding, laser cutting, water jet cutting, etching or electro-discharge machining.

10. Electrode device according to claim 6, wherein the recess in the electrode blank and/or the insulator is made by sawing, milling, grinding, laser cutting, water jet cutting, etching or electro-discharge machining and the recess in the electrode blank is alternatively provided by means of casting.

11. A mass spectrometer having a multipolar electrode device with pre- and/or postfilters, wherein the multipolar electrode device comprises at least two electrode assemblies wherein each electrode assembly comprises one or more rod-shaped electrode blanks, and each of the electrode blanks is connected to holding means and for each pre- and/or postfilter a gap separates the electrode blanks into two sections wherein the sections are axially spaced apart from each other by means of the gap and the holding means maintain the sections in a constant relative position to each other and that several electrode assemblies are assembled to the electrode device by connecting the holding means and insulating means and a carrier element are part of the holding means and the insulating means are connected to said electrode blank and the carrier element is connected to at least one insulator of the insulating means, whereby said at least one insulator is connected to both sections, so that the at least one insulator maintains the sections in the constant relative position to each other and the electrode blank and/or the at least one insulator has a recess which is or are connected to the gap and which separates or separate the at least one insulator from the gap.

* * * * *